United States Patent [19]

Bruning et al.

[11] Patent Number: 5,060,624

[45] Date of Patent: Oct. 29, 1991

[54] ENGINE IGNITION SYSTEM INCLUDING A TRANSFORMER ASSEMBLY AND POSITIONING MEANS THEREFOR

[75] Inventors: E. Eugene Bruning, Normal; Ronald D. Richardson, Pekin, both of Ill.

[73] Assignee: Caterpillar Inc., Peoria, Ill.

[21] Appl. No.: 624,841

[22] Filed: Dec. 10, 1990

[51] Int. Cl.[5] ..... F02P 15/00

[52] U.S. Cl. ..... 123/635; 123/169 PA

[58] Field of Search ..... 123/143 C, 169 PA, 169 PH, 123/635, 643, 647

[56] References Cited

U.S. PATENT DOCUMENTS

| | | | |
|---|---|---|---|
| 2,686,511 | 8/1954 | Platner | 123/143 C |
| 3,792,694 | 2/1974 | Brenholts | 123/635 |
| 4,706,639 | 11/1987 | Boyer et al. | 123/635 X |
| 4,715,337 | 12/1987 | Bohl et al. | 123/169 PA |
| 4,767,967 | 8/1988 | Tanaka et al. | 315/55 |
| 4,768,477 | 9/1988 | Richardson | 123/169 R |
| 4,831,995 | 5/1989 | Biton | 123/635 |
| 4,944,259 | 7/1990 | Richardson | 123/169 PA |
| 5,003,958 | 4/1991 | Yoneyama et al. | 123/635 |

FOREIGN PATENT DOCUMENTS

| | | | |
|---|---|---|---|
| 19948 | 2/1985 | Japan | 123/635 |

OTHER PUBLICATIONS

Article by C. L. McClung, entitled, "Design and Development of the Caterpillar 3500 Series Spark-Ignited Engine Family" and published by the American Society of Mechanical Engineers, circa 1984.

Patent Abstracts of Japan, vol. 9, No. 46, Feb. 27, 1985.

*Primary Examiner*—Tony M. Argenbright

*Attorney, Agent, or Firm*—Charles E. Lanchentin, Jr.

[57] ABSTRACT

Prior engine ignition systems for a multicylinder spark ignited engine have been too complex and have incorporated external wiring cables and a plurality of transformer assemblies that placed the individual primary and secondary coils thereof in an external location for better heat dissipation. Thus the cable and transformer assemblies were subject to damage by personnel working on the engine. These problems have been overcome by the engine ignition system including a transformer assembly having an elongate body including a cup portion containing the coils, a base portion, and a stem portion. A conducting core extends through the stem and base portions and a suitable clip connects the core electrically to a spark plug installed in a profiled bore of the cylinder head. A position device is provided to positively align and contain the transformer assembly within a valve mechanism compartment defined between the cover and the cylinder head, and including a spring member connected to the cup portion and depending guide members formed within the cover that cooperate with each other.

18 Claims, 3 Drawing Sheets

ENGINE IGNITION SYSTEM INCLUDING A TRANSFORMER ASSEMBLY AND POSITIONING MEANS THEREFOR

DESCRIPTION

1. Technical Field

This invention relates generally to an ignition system for an internal combustion engine, and more particularly to a transformer assembly releasably connected to a spark plug of such an engine and the positioning thereof within the valve mechanism compartment.

2. Background Art

On spark ignited, internal combustion engines the ignition transformer assemblies are typically mounted in an external location. Accordingly, the transformer assemblies and the wiring harnesses leading to them have been vulnerable to damage resulting from a person stepping on them or using them for a hand hold while performing routine tasks on the top of the engine. As a result it has been necessary to adapt costly heavy duty constructions to minimize such external damage.

U. S. Pat. No. 4,768,477 issued on Sept. 6, 1988 to R. D. Richardson is one example of an engine ignition system including an ignition transformer that is releasably mounted on the upper surface of a valve mechanism cover. A low tension cable extends externally to the ignition transformer, and the ignition transformer contains the primary and secondary coils within an elongate cylindrical container that projects upwardly from the cover. A relatively complex ignition extender is used to couple the ignition transformer to the spark plug, and a separate tubular element contains the ignition extender in a sealed cavity by telescopically engaging the cover and the spark plug bore defined in the cylinder head. U. S. Pat. No. 4,715,337 issued on Dec. 29, 1987 to P. B. Bohl et al. illustrates and explains that telescopic arrangement.

While the systems disclosed in U. S. Pat. Nos. 4,768,477 and 4,715,337 have been reasonably successful, they have incorporated a significant number of parts that have caused additional assembly and disassembly effort, and the complexity and external location of portions thereof have contributed to certain reliability problems. Moreover, the ignition transformer is so constructed and located that it is prone to causing more electromagnetic radiation and possible interference with other electronic equipment than is desired.

What is desired is a less complex, and less costly ignition system including a transformer assembly that would be easier to connect releasably to a spark plug, and that would be contained protectedly within the valve mechanism compartment. Besides having few parts, the transformer assembly should preferably be unitized for easy installation and be ruggedly constructed for resistance to the hot oil environment so typically encountered in a heavy duty engine for greater reliability.

The present invention is directed to overcoming one or more of the problems as set forth above.

DISCLOSURE OF THE INVENTION

In one aspect of the present invention an engine has a cylinder head defining a profiled bore and a spark plug seated in the profiled bore, and an ignition transformer assembly is adapted to be positioned in the profiled bore and connected to the spark plug. The ignition transformer assembly includes an elongate body of a dielectric material defining a cup portion containing a primary coil and a secondary coil, a coupling member extending from the cup portion and being electrically connected to the primary coil, a base portion sealingly engageable with the profiled bore, and a stem portion interconnecting the cup and base portions. A conducting element is connected to the secondary coil and extends through the stem and base portions, and a contact device is provided for releasably connecting the conducting element with the spark plug.

In another aspect of the invention an engine ignition system is provided for an engine including a cylinder head defining a profiled bore and a spark plug connected to the cylinder head in the profiled bore. The engine ignition system advantageously includes a transformer assembly for converting an input low tension voltage signal to a high voltage signal directed to the spark plug, and with the transformer assembly including a dielectric body, a conducting element extending substantially through the body, and a contact device releasably connectable to the spark plug. A cover apparatus is connected to the cylinder head and protects the transformer assembly, and a positioning device is provided for releasably securing the transformer assembly in the profiled bore cooperatively with the cover apparatus.

The engine ignition system of the present invention has few parts and a transformer assembly that is basically a modular subassembly that is easily installed and releasably secured in place by a cooperating and protecting valve mechanism cover. The transformer assembly is also so constructed and arranged that the coils and associated electrical elements contained therein are securely contained and protected from the hot oil environment and in a position wherein a minimum of electrical radiation is emitted therefrom.

BEST MODE FOR CARRYING OUT THE INVENTION

Figure 1:
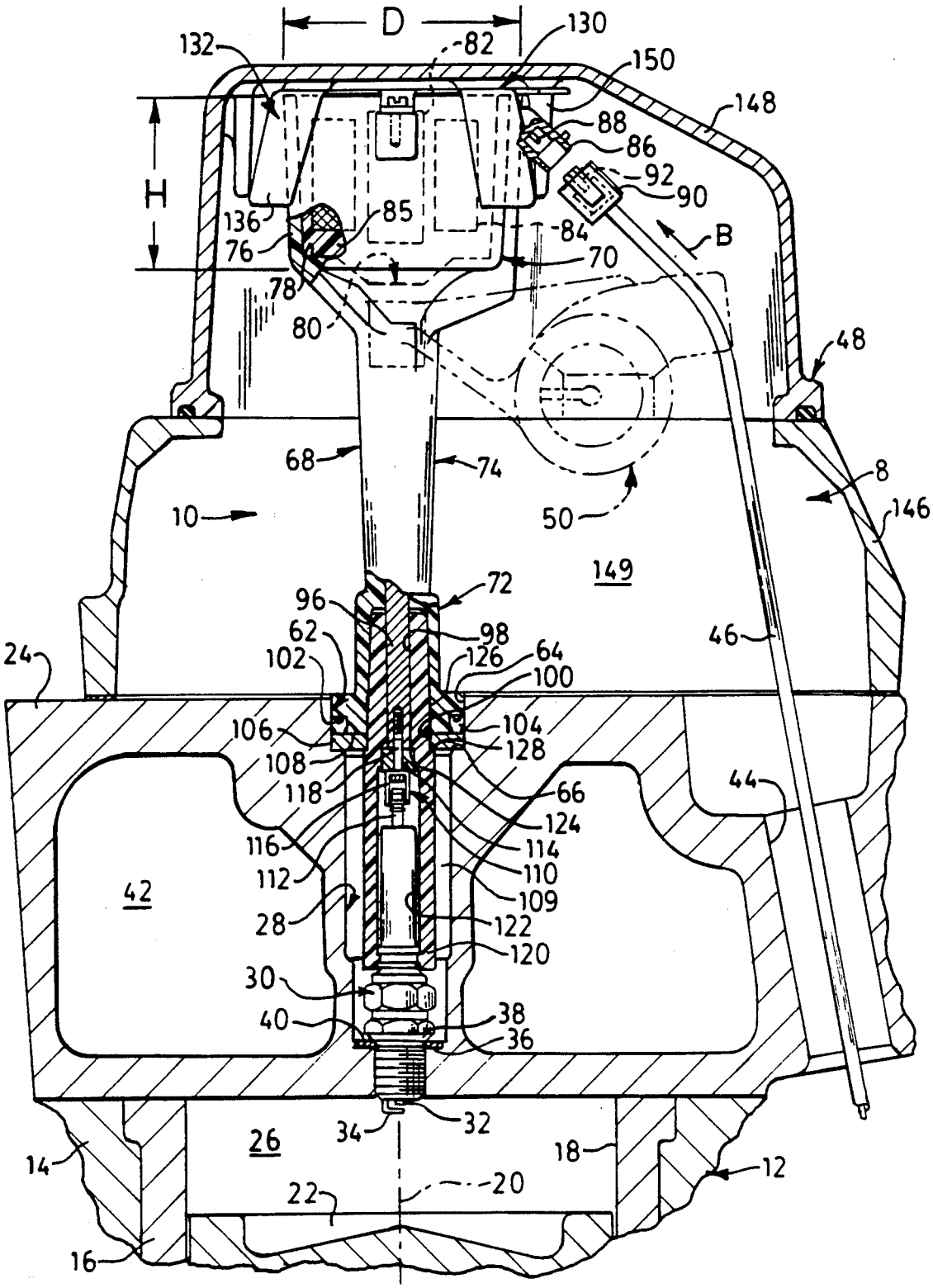
FIG. 1 is a diagrammatic elevational view of an engine ignition system constructed in accordance with one embodiment of the present invention, with certain portions of a transformer assembly and the engine shown in cross section to better illustrate details thereof.

An engine ignition system 8 includes a transformer assembly 10 as is shown in FIG. 1 which is adapted for use with one cylinder of a multicylinder internal combustion engine 12. The engine has a block 14, a plurality of cylinder liners 16 in the block, one of which is shown, and with each one of the liners defining a piston bore 18 having a central axis 20. A piston 22 is reciprocably disposed in each of the bores, and a cylinder head 24 is releasably connected to the block 14 so that a combustion chamber 26 is defined between the liner 16, the piston 22 and the cylinder head at each piston as is the conventional case. The cylinder head 24 has a profiled bore 28 therethrough concentrically arranged along the central axis 20, and a spark plug 30 is threadably secured to the cylinder head in the lower part of the profiled bore so that an active or chargeable electrode 32 and a grounded electrode 34 extend downwardly into the combustion chamber 26. As used herein, the terms downwardly, upwardly, top, lower and the like should be considered relative to viewing FIG. 1 and the central axis 20 thereof, since on a V-shaped engine the piston bores 18 would clearly be angularly inclined with respect to a vertical axis. A sealing washer 36 is urged by a flange 38 on the spark plug 30 tightly against an annular seat 40 formed by the profiled bore 28 to prevent the flow of any gas or liquid by the spark plug in the usual way.

The cylinder head 24 also defines a water filled chamber 42 about the profiled bore 28, and a passage 44 permitting a low tension cable 46 to be inserted upwardly therethrough without passing through a cover means or cover apparatus 48. The cover apparatus 48 is releasably secured to the upper surface of the cylinder head for sealingly containing a valve operating mechanism 50 as is only partially illustrated in phantom lines in FIG. 1. As is shown in broken and phantom outline in FIG. 3, the valve operating mechanism 50 includes first and second rocker arms 52 and 54 which are cyclically rocked in a normal manner about an axis 56 to respectively depress a pair of intake valves 58 and a pair of exhaust valves 60 during operation of the engine 12. Referring to FIG. 1, the profiled bore 28 of the cylinder head 24 also has an upwardly facing counterbore 62 defining a smooth cylindrical sealing surface 64 and an upwardly facing annular seat 66.

Figure 2:
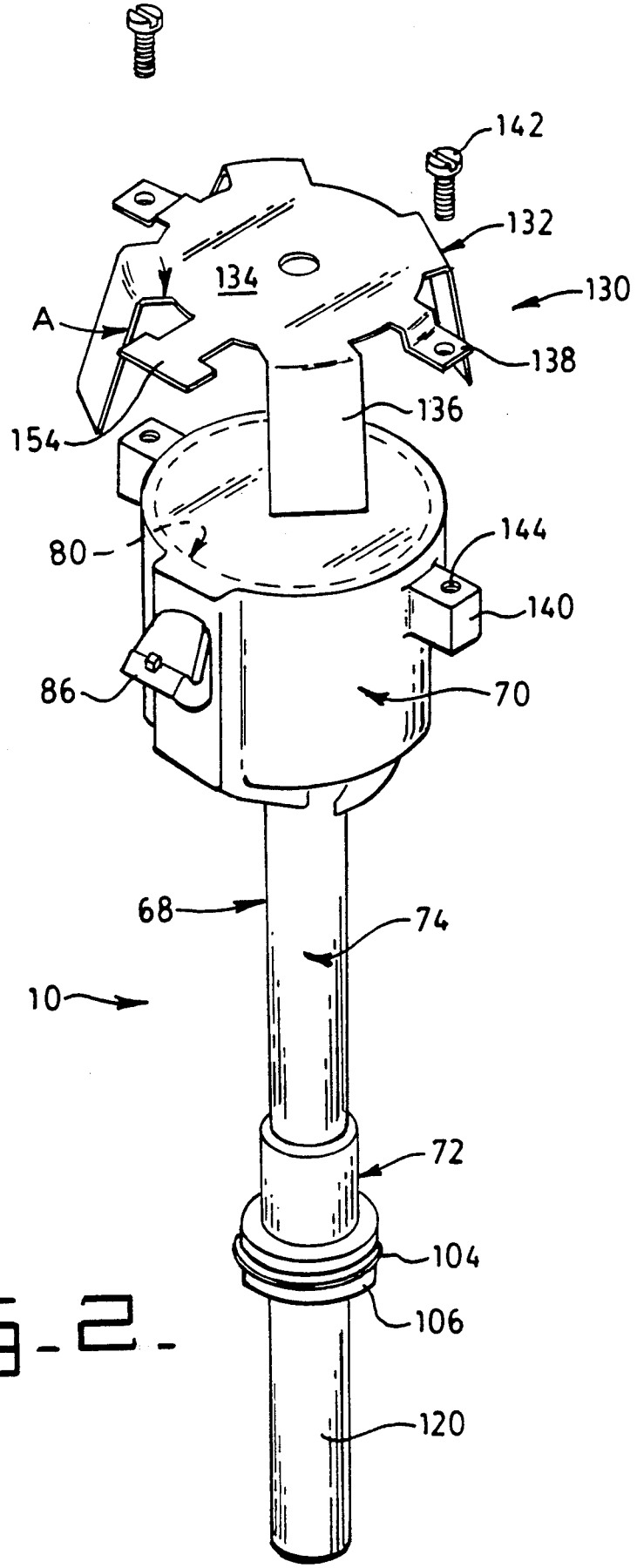
FIG. 2 is an enlarged, diagrammatic, pictorial view of the transformer assembly shown in FIG. 1 with a few parts exploded away from the main body thereof.

As is shown in FIGS. 1 and 2, the ignition transformer assembly 10 includes a unitized elongate body 68 constructed of a dielectric material and including an upper cup portion 70, a lower base portion 72, and a stem portion 74 interconnecting the cup and base portions. The cup portion 70 has a generally cylindrical wall 76 and a bottom 78 defining an upwardly facing cavity 80 adapted to receive a generally cylindrical primary coil 82 arranged along the central axis 20, and an annular secondary coil 84 disposed about the primary coil. A potting compound 85 and a few internal support elements, not shown, contain and position the coils 82 and 84 in a molded and sealed relationship within the cup portion 70. An electrical coupling member 86 extends radially outwardly from the cup portion and, in this embodiment, includes two connecting pins 88 that extend downwardly in an inclined, parallel manner and that are electrically connected to the opposite ends of the primary coil 82. A quick-release, snap-on type female coupling member 90, shown in FIG. 1 in an axially displaced position away from the male coupling member 86 for clarity, has two mating apertures 92 therein that are electrically connected to the cable 46. The cable 46 leads to a capacitive discharge or inductive type ignition system of any conventional type, which is not illustrated herein since it forms no part of the present invention.

An electrically conducting metallic core or solid cylindrical element 96 is disposed tightly within a corresponding passage 98 defined through the base and stem portions 72 and 74 of the main body 68 of the transformer assembly 10, and is electrically connected to the secondary coil 84 internally within the cup portion 70. The base portion 72 defines a generally downwardly facing and divergingly tapered counterbore 100 and an annular groove 102 therearound. Preferably, the annular groove 102 is completed or fully defined after a sealing ring 104 is installed at least partially therein by the subsequent addition of a containment washer 106 that is secured tightly against an intermediate bottom surface 108 of the base portion. The washer 106 is preferably of metal for improved engagement with the cylindrical seat 66, and is glued or otherwise rigidly secured to the remainder of the dielectric body 68. The upper sealing ring 104 and the lower sealing washer 36 delineate the opposite ends of an enclosed chamber 109 within the profiled bore 28.

Contact means 110 is provided generally below the base portion 72 for releasably connecting the conducting core 96 electrically to a metallic terminal 112 of the spark plug 30. Preferably, the contact means 110 includes a hollow, metallic spacer element 114, a conventional metallic quick-disconnect clip 116, and a fastener or bolt 118 that extends through the clip and spacer element and is threadably secured to the core 96. Furthermore, the ignition transformer assembly 10 includes a generally tubular insulating shield 120 having a stepped counterbore 122 therein defining a downwardly facing annular seat 124. The shield 120 also has a reduced diameter upper cylindrical surface 126 with a length delineated by an upwardly facing annular seat 128. As a result of this construction the spacer element 114 of the contact means 110 serves to abut the internal seat 124 and secure the shield 120 upwardly into a tight and sealed registry with the conically tapered counterbore 100 of the base portion 72. Simultaneously, the outer seat 128 of the shield 120 is urged tightly against the washer 106.

Advantageously, a spring-like or flexible positioning means 130 is provided intermediate the cup portion 70 of the transformer assembly 68 and the cover means 48 for resiliently securing the transformer assembly in an aligned relationship with the central axis 20 and for resiliently urging the transformer assembly downwardly and assuring more positive registry of the washer 106 with the seat 66, and the contact means 100 with the spark plug terminal 112. More specifically, the positioning means 130 includes a metallic spring member 132 having a generally circular flat body 134 and four deflectable legs 136 extending therefrom. The legs 136 are flat, thin, and flexible, and in the free state are inclined downwardly to individually define a preselected angle A with respect to the flat body 134 as is illustrated in FIG. 2. A pair of apertured tangs or feet 138 also extend integrally from the body 134 and are releasably secured to a corresponding pair of mounting bosses 140 integrally formed on the outside of the cup portion 70. A pair of fasteners or bolts 142 can be inserted through the feet 138 and be screwthreadably engaged with threaded bores 144 in the bosses to tightly secure the spring member 132 to the remainder of the transformer assembly 10.

Referring now to FIG. 1, the cover means 48 in the instant embodiment includes a valve mechanism base 146 releasably and sealingly secured to the upper surface of the cylinder head 24, and a separate cover 148 releasably and sealingly secured to the base 146 in a conventional manner. It can be appreciated, however, that these two pieces could be integrated into a single cover without departing from the spirit of the present invention. The enclosed space defined generally below the cover means 48 and above the top surfaces of the cylinder head 24 can be referred to as a generally enclosed valve mechanism compartment 149.

Figure 3:
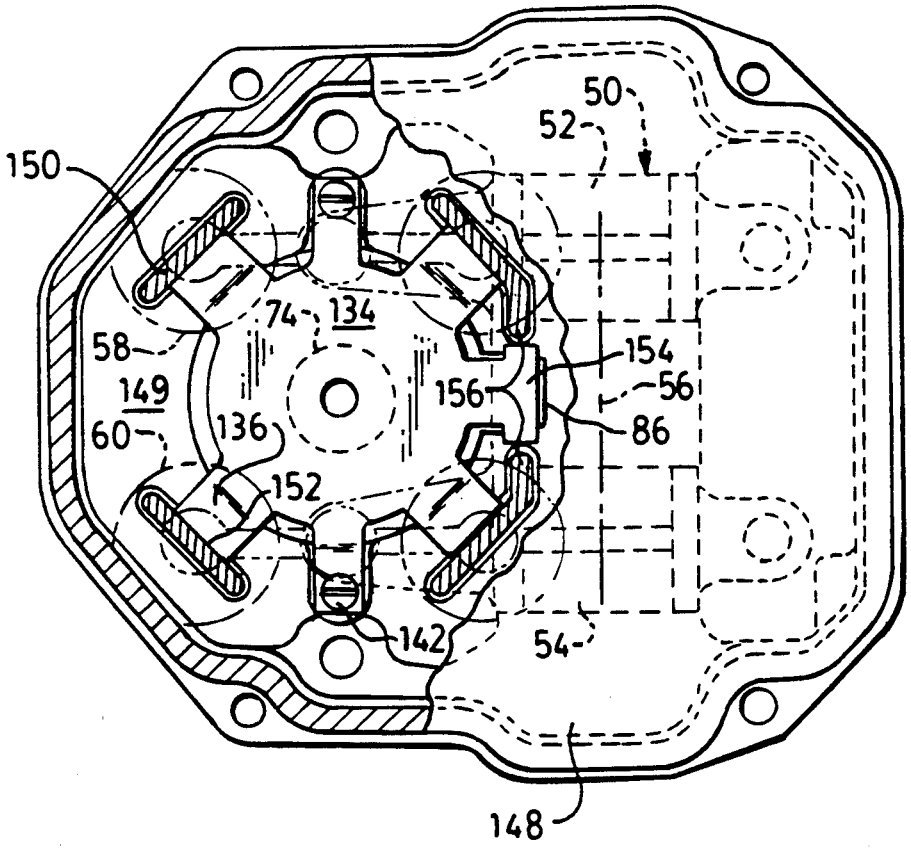
FIG. 3 is a diagrammatic top view of the engine ignition system shown in FIG. 1 with a portion of the cover broken away to better illustrate the positioning means associated with the top of the transformer assembly, and showing by broken and phantom lines certain portions of the engine's valve mechanism.

As is best shown in FIG. 3, the cover 148 has integrally formed therewithin four depending guide members 150 shown in cross section that collectively present slightly downwardly diverging planar surfaces 152 arranged generally orthogonically with respect to each other. A t-shaped tab 154 also extends radially outwardly from the body 134 in the same plane thereof and in a vertically covering and protecting relationship with respect to the coupling member 86. This t-shaped tab is relatively closely spaced between a pair of extended and profiled edges 156 on two of the guide members 150 for a purpose that will later be explained.

INDUSTRIAL APPLICABILITY

The elongate body 68 of the transformer assembly 10 is preferably constructed from an electrically nonconducting or dielectric material selected from the group consisting of RYNITE 935 (RYNITE is a registered trademark of E.I.duPont de Nemours & Co. Inc.) of Wilmington, Del. for its thermoplastic polyester resins), ULTEM 2300 (ULTEM is a registered trademark of General Electric Company of Fairfield, Conn.), VICTREX PES (VICTREX is a registered trademark of Imperial Chemical Industries PLC), and the polyamide (NYLON) family of thermoplastic resins such as heat stabilized Nylon 6/6. The preferred RYNITE 935 material is a 35% mica/glass reinforced modified polyethylene terephthalate having superior stiffness, dimensional stability, and resistance to heat and creep. The remaining materials in the preferred group are approximately 30% glass filled. Such materials have the ability to withstand an engine operating temperature of approximately 150° C. (300° F.) and to be able to tolerate being partially submerged in hot oil or sprayed with hot oil as is typically encountered within the valve mechanism compartment 149.

The material of the elongate body 68 and the material of the potting compound 85 supporting the coils 82 and 84 in a centered relationship with respect to the central axis 20 should also be compatible with each other so as to provide a good bond therebetween, and to better isolate the coils in the cup portion 70 from any hot oil being splashed against the transformer assembly 10 in use. More particularly, the potting compound 85 is preferably an epoxy compound such as BIWAX 1173 (BIWAX is a registered trademark of the BIWAX Corporation of Des Plaines, Ill.).

The sealing ring 104 is preferably made from a VITON material (VITON is a registered trademark of E.I duPont de Nemours & Co. Inc.). Preferably, the sealing ring 104 serves as a one-way acting pressure relief seal, and is of a known cup or lip type cross section so as to have directional sealing characteristics with respect to the cylindrical sealing surface 64 of the counterbore 62. For example, the lip portion of the sealing ring 104 is preferably oriented upwardly and radially outwardly in an inclined manner to provide preferably automatic relief of any pressure above a preselected pressure relief value that ma have accumulated in the enclosed chamber 109 immediately around the spark plug 30. Such orientation of the lip portion still positively prevents oil from penetrating downwardly into the enclosed chamber.

The transformer assembly 10, including the shield 120 and the spring member 132 installed on the top of the cup portion 70, is initially put together as an easy to hold subassembly as is shown in FIG. 2. The shield 120 is located in the profiled bore 28 in a location experiencing temperatures of approximately 200° C. (400° F.), and is preferably made of polytetrafluoroethylene. This subassembly is inserted downwardly in the profiled bore 28 so that the spring clip 116 flexibly grasps the terminal 112 of the spark plug 30, the washer 106 is positively positioned against the seat 66, and the sealing ring 104 is sealingly engaged with the cylindrical surface 64. The female coupling member 90 of the low tension cable 46 can then be urged upwardly in an inclined manner, as is indicated by arrow B in FIG. 1, into engagement with the male coupling member 86. This permits a voltage signal of approximately 190 volts to be controllably directed through the coupling members to the primary coil 82 when the engine 12 is being operated. Although not shown, a capacitive discharge type of ignition control unit is used to provide the controlling voltage signal to the primary coil 82. The secondary coil 84 is electrically connected to the spark plug 30, and due to the greater number of coils than the primary coil, can theoretically deliver, for example, approximately 33,000 volts to the spark plug. Such a high voltage is particularly desirable for lean gas burning engines operating at relatively high compression ratios.

After the cable 46 is connected to the transformer assembly 10 the cover 148 can be lowered into engagement therewith. The legs 136, which are individually disposed at the initial angle A with respect to the upper body 134 as is shown in FIG. 2, are engaged by the orthogonally arranged guide members 150 formed within the cover 148. This tends to rotate the transformer assembly to the desired orientation so that the coupling member 86 and the T-shaped tab 154 are directed precisely toward the axis 56 of the rocker arms 52 and 54. The T-shaped tab !54 protects the coupling member 86 as the cover is being lowered and specifically limits the rotation of the transformer assembly because of the close position thereof within the profiled edges 156 of two of the guide members. Further lowering of the cover deflects the legs 136 such that an angle smaller than the angle A is subtended, and results in the legs resiliently loading or holding the upper part of the transformer assembly.

The relatively small diameter of the stem portion 74 of the body 68 allows adequate clearance from the valve operating mechanism 50 as can be appreciated by reference to FIG. 3. Furthermore, the cup portion 70 is preferably as short as is practical in order to limit the maximum elevation of the cover 148 above the upper surface of the cylinder head 24. In the embodiment illustrated in FIG. 1 the generally cylindrical cup portion 70 has a diameter D essentially equal to the height H. Advantageously, this equivalency provides a generally shorter secondary coil 84 and this provides better high voltage capability by enabling somewhat smaller voltage differentials between adjacent secondary coil wires and greater reliability.

The air in enclosed chamber 109 defined within the profiled bore 28 and generally about the spark plug 30 is slightly compressed when the transformer assembly !0 is initially installed in the cylinder head 24 at an ambient temperature. When the engine 12 is subsequently operated the heat generated naturally increases the pressure in the enclosed chamber 109, which desirably increases the arc-over resistance. This pressure value is below the pressure relief value of the sealing ring 104.

In view of the foregoing, it can be appreciated that the transformer assembly 10 has relatively few parts, and is rugged and reliable because of the unitized or modular construction of the dielectric body 68 which contains the coils 82 and 84, the conducting core 96, and the coupling member 86 in a protected relationship from the hot oil. The contact means 110 can be easily connected to the spark plug 30 and the downward movement of the cover 48 during installation causes the guide members 150 to automatically align the dielectric body 68 by resilient engagement with the spring legs 136. And furthermore, all of the transformer assemblies and associated cables 46 leading thereto are safely disposed within the covers where external electromagnetic interference is minimal.

Other aspects, objects and advantages of this invention can be obtained from a study of the drawings, the disclosure and the appended claims.

We claim:

1. An engine ignition transformer assembly adapted to be positioned in a profiled bore of a cylinder head of an engine in an electrically connected relationship to a spark plug seated in the profiled bore, comprising:

an elongate body constructed of a dielectric material including a cup portion generally containing a primary coil and a secondary coil, an electrical coupling member extending outwardly from the cup portion and being electrically connected to the primary coil, a base portion adapted to be sealingly engaged with the profiled bore, and a stem portion interconnecting the cup and base portions;

a conducting element electrically connected to the secondary coil and extending through the stem and base portions; and contact means for releasably connecting the conducting element to the spark plug.

2. The engine ignition transformer assembly of claim 1 wherein the cup portion contains a potting compound disposed in a supporting and protecting relationship about the coils.

3. The engine ignition transformer assembly of claim 1 wherein the cup portion is generally cylindrical and has a diameter D, and the height H thereof is generally equal to the diameter D.

4. The engine ignition transformer assembly of claim 1 wherein the base portion has a peripheral groove and a sealing ring disposed in the groove and adapted to sealingly engage the profiled bore.

5. The engine ignition transformer assembly of claim 4 wherein the spark plug includes a sealing member and that sealing member and the sealing ring delineate an enclosed chamber within the profiled bore that is, in use, naturally pressurized to provide increased arc-over resistance.

6. The engine ignition transformer assembly of claim 4 wherein the contact means includes a tubular shield adapted to surround, in use, an upper portion of the spark plug.

7. The engine ignition transformer assembly of claim 1 including positioning means for securing the elongate body in an aligned relationship with the profiled bore.

8. The engine ignition transformer assembly of claim 7 wherein the positioning means includes a metallic spring member having a plurality of deflectable legs releasably secured to the cup portion of the elongate body.

9. The engine ignition transformer assembly of claim 8 wherein the engine includes a cover having a plurality of guide members that are adapted, in use, to deflect the legs and properly orient the elongate body.

10. The engine ignition transformer assembly of claim 1 including sealing ring means connected to the body for sealingly engaging the profiled bore and automatically relieving any pressure above a preselected value that may have accumulated around the spark plug and within the profiled bore.

11. An engine ignition system for an engine including a cylinder head defining a profiled bore therethrough and having a spark plug secured to the cylinder head in the profiled bore, comprising:

transformer means for converting an input low tension voltage signal to a high voltage signal and directing the high voltage signal to the spark plug, the transformer means including a dielectric body, a conducting element extending substantially through the body, and contact means for releasably connecting the conducting element to the spark plug;

cover means connected to the cylinder head for sealingly protecting the transformer means; and positioning means for releasably securing the transformer means in the profiled bore with the contact means connected to the spark plug, the positioning means acting cooperatively between the cover means and the transformer means.

12. The engine ignition system of claim 11 wherein the dielectric body includes an upper cup portion, a lower base portion, and a stem portion interconnecting the cup and base portions.

13. The engine ignition system of claim 12 wherein the transformer means includes a spring member connected to the dielectric body and having a plurality of deflectable legs.

14. The engine ignition system of claim 13 wherein the cover means defines a plurality of guide members and the positioning means includes the spring member connected to the dielectric body and the plurality of guide members.

15. The engine ignition system of claim 14 wherein the cover means includes a cover, the guide members extend generally integrally downwardly from the cover, and during installation of the cover on the cylinder head the guide members serve to deflect the legs of the spring member and positively position the dielectric body in an aligned relationship to the profiled bore.

16. An engine ignition system for an engine including a cylinder head defining a profiled bore therethrough and having a spark plug secured to the cylinder head in the profiled bore along a central axis thereof, comprising:

a transformer assembly including a dielectric body, a conducting core extending substantially through the body, and a contact device for releasably connecting the conducting core to the spark plug;

a spring member connected to the dielectric body and having a plurality of deflectable elements; and a cover defining a plurality of guide members adapted, in use, to deflectably engage the legs of the spring member and releasably retain the dielectric body in the profiled bore in an aligned relationship with the central axis.

17. The engine ignition system of claim 16 wherein the dielectric body includes a cup portion containing a primary coil and a secondary coil, a base portion sealingly engaging the profiled bore, and a stem portion interconnecting the cup and base portions.

18. The engine ignition system of claim 17 wherein the material of the dielectric body is a thermoplastic polyester resin.

* * * * *